US010082302B2

(12) United States Patent
Yoon et al.

(10) Patent No.: US 10,082,302 B2
(45) Date of Patent: Sep. 25, 2018

(54) DEHUMIDIFIER

(71) Applicant: LG ELECTRONICS INC., Seoul (KR)

(72) Inventors: Sangjun Yoon, Seoul (KR); Sungho Seo, Seoul (KR); Ilsoo Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 667 days.

(21) Appl. No.: 14/674,209

(22) Filed: Mar. 31, 2015

(65) Prior Publication Data

US 2015/0276242 A1 Oct. 1, 2015

(30) Foreign Application Priority Data

Mar. 31, 2014 (KR) ..... 10-2014-0038279
Jul. 4, 2014 (KR) ..... 10-2014-0084035

(51) Int. Cl.
*F25D 21/14* (2006.01)
*F24F 3/14* (2006.01)
(Continued)

(52) U.S. Cl.
CPC ..... *F24F 3/14* (2013.01); *F24F 1/02* (2013.01); *F24F 3/1405* (2013.01); *F24F 13/20* (2013.01);
(Continued)

(58) Field of Classification Search
CPC .... F24F 3/14; F24F 3/1405; F24F 1/02; F24F 13/20; F24F 13/22; F24F 2003/1446;
(Continued)

(56) References Cited

U.S. PATENT DOCUMENTS 5,156,048 A * 10/1992 DeFigueiredo ..... G01F 23/74 200/84 R
6,415,618 B1 * 7/2002 Sul ..... F24F 3/153 62/188
(Continued)

FOREIGN PATENT DOCUMENTS

CN 1862120 A1 11/2006
CN 1880865 12/2006
(Continued)

OTHER PUBLICATIONS

Sierra Pacific Engineering and Products. (Feb. 23, 2012). Bolt Latches. Retrieved Sep. 26, 2017, from http://www.spep.com/Latches/Bolt-Latch.html Electronic publishing date verified with the wayback machine website.*
(Continued)

*Primary Examiner* — Keith Raymond
*Assistant Examiner* — Miguel A Diaz
(74) *Attorney, Agent, or Firm* — KED & Associates LLP

(57) ABSTRACT

A dehumidifier may include: a main body; a heat exchange unit mounted inside the main body; and a water tank mounted inside the main body and separated or mounted through a side surface of the main body, the water tank storing condensed water formed on the heat exchange unit. The water tank may include: a case of which a front surface defines a portion of the side surface of the main body in a state where the case is mounted inside the main body, the case defining a space for storing the condensed water; a cover selectively opening or closing a top surface of the case; and a coupling module passing through the cover and a side surface of the case to protrude to an outside of the case, and coupled to the main body.

9 Claims, 17 Drawing Sheets

(51) Int. Cl.
*F24F 13/20* (2006.01)
*F24F 13/22* (2006.01)
*F24F 1/02* (2011.01)

(52) U.S. Cl.
CPC ..... *F24F 13/22* (2013.01); *F24F 2003/1446* (2013.01)

(58) Field of Classification Search
CPC .... F24F 11/0086; F24F 11/02; F24F 11/0009; F24F 13/222; F24F 2003/144; G01F 23/74; G08B 21/182; H01H 35/18
See application file for complete search history.

(56) References Cited

U.S. PATENT DOCUMENTS 7,856,840 B2 * 12/2010 Yoon ..... B01D 53/06 62/285
7,909,922 B2 * 3/2011 Jang ..... F24F 13/1406 96/405
8,097,073 B2 * 1/2012 Jang ..... F24F 3/14 62/150
8,978,303 B1 * 3/2015 Rogers ..... E05D 15/22 292/175
2001/0037630 A1 * 11/2001 Eom ..... F24F 3/1405 55/467
2002/0023445 A1 * 2/2002 Sul ..... F24F 3/153 62/188
2006/0278084 A1 12/2006 Kim
2006/0278085 A1 * 12/2006 Kim ..... B01D 53/261 96/140
2006/0283327 A1 * 12/2006 Yoon ..... B01D 53/06 96/143
2007/0289320 A1 * 12/2007 Bhatti ..... F24F 3/14 62/179
2009/0120118 A1 * 5/2009 Yoon ..... F24F 3/14 62/259.1
2009/0158934 A1 * 6/2009 Jang ..... F24F 13/1406 96/189
2011/0247352 A1 * 10/2011 Zanolin ..... F24F 3/14 62/263
2015/0192312 A1 * 7/2015 Jung ..... F24F 3/1405 62/291
2015/0267929 A1 * 9/2015 Kim ..... F24F 5/001 62/89
2016/0061484 A1 * 3/2016 Wu ..... F24F 13/222 137/135
2016/0131372 A1 * 5/2016 Choi ..... F24F 3/14 62/189
2016/0153672 A1 * 6/2016 McDonnell ..... F24F 6/14 261/5
2016/0153824 A1 * 6/2016 Myeong ..... F24F 3/1405 73/306
2017/0016637 A1 * 1/2017 Choi ..... F24F 3/14

FOREIGN PATENT DOCUMENTS

CN 2009-65334 10/2007
CN 203375628 U 1/2014
EP 1 930 197 6/2008
JP H0989297 4/1997
JP 2001-263722 A 9/2001
JP 2001-349575 A 12/2001
JP 2004-061042 A 2/2004
JP 2007-253138 A 10/2007
JP 2008-200596 A 9/2008
JP 2008-302293 A 12/2008
KR 20-0115552 Y1 4/1998
KR 10-2006-0129678 A 12/2006
KR 20070044216 A * 4/2007
KR 20-2009-0002371 U 3/2009
KR 10-2013-0138478 A 12/2013
KR 20130138478 A * 12/2013
KR 10-2014-0027809 A 3/2014
KR 20140110654 A * 9/2014
KR 101526188 B1 * 6/2015

OTHER PUBLICATIONS

Chinese Office Action dated Mar. 30, 2017 issued in Application No. 201510136694.6 (English Translation included).
Korean Office Action dated Jul. 6, 2015 issued in Application No. 10-2014-0084035.
European Search Report dated Aug. 19, 2015 issued in Application No. 15161876.6.

* cited by examiner

DEHUMIDIFIER

CROSS-REFERENCE TO RELATED APPLICATIONS

The present application claims benefits of priority to Korean Patent Application Nos. 10-2014-0038279, filed Mar. 31, 2014 and 10-2014-0084035, filed Jul. 4, 2014, the subject matter of which are incorporated herein by reference.

BACKGROUND

1. Field

Embodiments may relate to a dehumidifier.

2. Background

Dehumidifiers are home appliances that suction air within a specific space to remove moisture contained in the air and discharge the dehumidified air into the specific space to maintain the air within the specific space in a dried state.

Such a dehumidifier suctions air within a specific space to allow the suctioned air to pass through a heat exchanger including a condenser and an evaporator and to be heat-exchanged with a refrigerant flowing along insides of the condenser and evaporator, thereby removing moisture contained in the air.

The evaporator may absorb heat from surrounding air to evaporate a liquid refrigerant. Thus, air passing through the evaporator may decrease in temperature through the heat-exchange with the refrigerant.

Since the air passing through the evaporator decreases in temperature, moisture contained in the air may be condensed to form dew on a surface of the evaporator.

The air that decreases in humidity and temperature while passing through the evaporator may be heated and dried while passing through the condenser.

The dehumidifier may dehumidify and dry air having relatively high humidity to change into dehumidified and dried air and then discharge the air into an indoor space.

In recent years, as residential space is expanded, and a living environment changes, a high-capacity and multifunctional humidifier may require as desired.

One arrangement (disclosed in Korean Patent Publication No. 10-2005-0083417, the subject matter of which is incorporated herein by reference) may relate to a bucket structure of a dehumidifier, which may prevent condensed water from leaking to outside even though the condensed water within the dehumidifier is significantly fluctuated when the user carries the dehumidifier so as to discard the condensed water.

In the dehumidifier having the above-described structure, when a predetermined amount or more of condensed water is received in the bucket, the bucket may be withdrawn forward by a user to remove the condensed water, and then the bucket may be inserted again.

However, as the dehumidifier increases in capacity, an amount of condensed water to be received may increase. As a result, it may be difficult to allow a user to withdraw the bucket or remove the condensed water due to the increasing weight of the condensed water.

In view of this limitation, an arrangement related to a dehumidifier, of which a water tank is easily manipulated, is disclosed in Korean Patent Publication No. 10-2013-0138478, the subject matter of which is incorporated herein by reference.

In the publication patents, a water tank is separably installed in a recessed water tank mounting part of a main body, and the water rotates in one direction. Thus, in a state where the water tank rotates, the water tank is capable of being withdrawn from the water tank mounting part.

However, since the water tank is disposed at a front surface of the dehumidifier to rotate forward so that the water tank is manipulated to rotate in the publication patent, an outer appearance of the front surface of the dehumidifier may be poor.

SUMMARY

In at least one embodiment, a dehumidifier includes: a main body defining an outer appearance thereof; a heat exchange unit mounted inside the main body; and a water tank mounted inside the main body and separated or mounted through a side surface of the main body, the water tank storing condensed water formed on the heat exchange unit. The water tank may include: a case of which a front surface defines a portion of the side surface of the main body in a state where the case is mounted inside the main body, the case defining a space for storing the condensed water; a cover selectively opening or closing a top surface of the case; and a coupling module passing through the cover and a side surface of the case to protrude to an outside of the case, and coupled to the main body.

Details of one or more embodiments may be set forth in the accompanying drawings and the description below. Other features may be apparent from the description and drawings.

BRIEF DESCRIPTION OF THE DRAWINGS

Embodiments may be described in detail with reference to the following drawings in which like reference numerals refer to like elements and wherein.

DETAILED DESCRIPTION

Exemplary embodiments may be described in detail with reference to the accompanying drawings.

Figure 1:
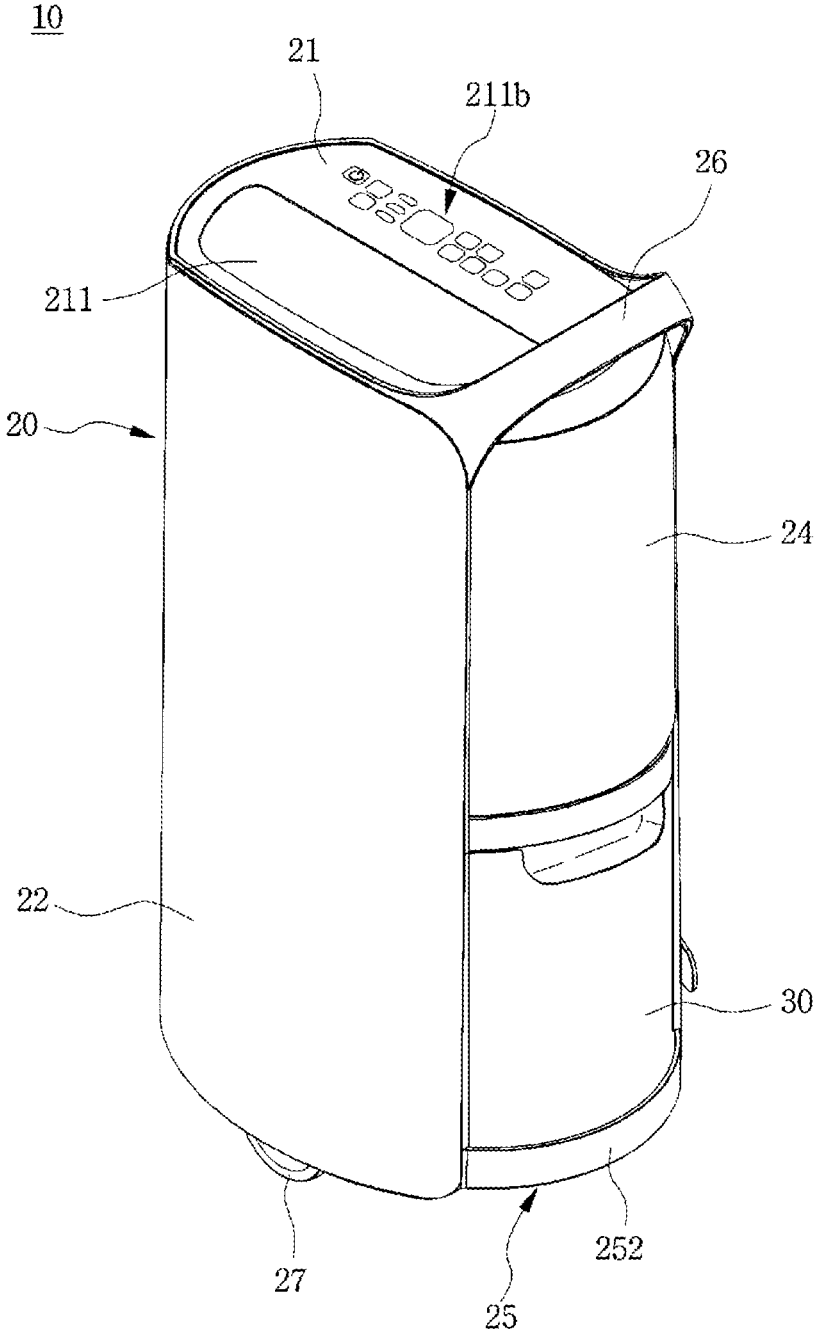
FIG. 1 is a front perspective view illustrating an outer appearance of a dehumidifier according to an embodiment.
Figure 2:
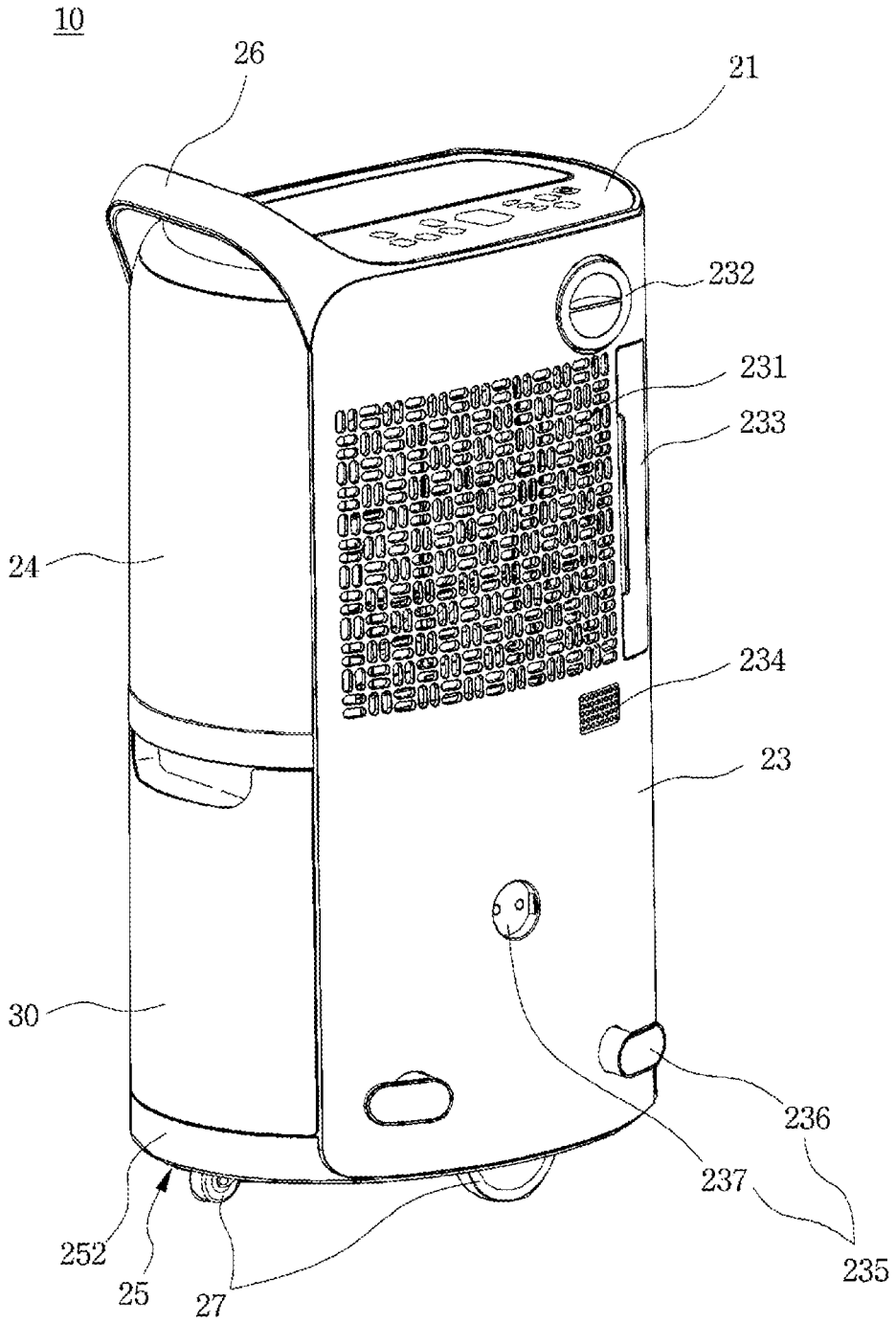
FIG. 2 is a rear perspective view illustrating the outer appearance of the dehumidifier according to an embodiment.
Figure 3:
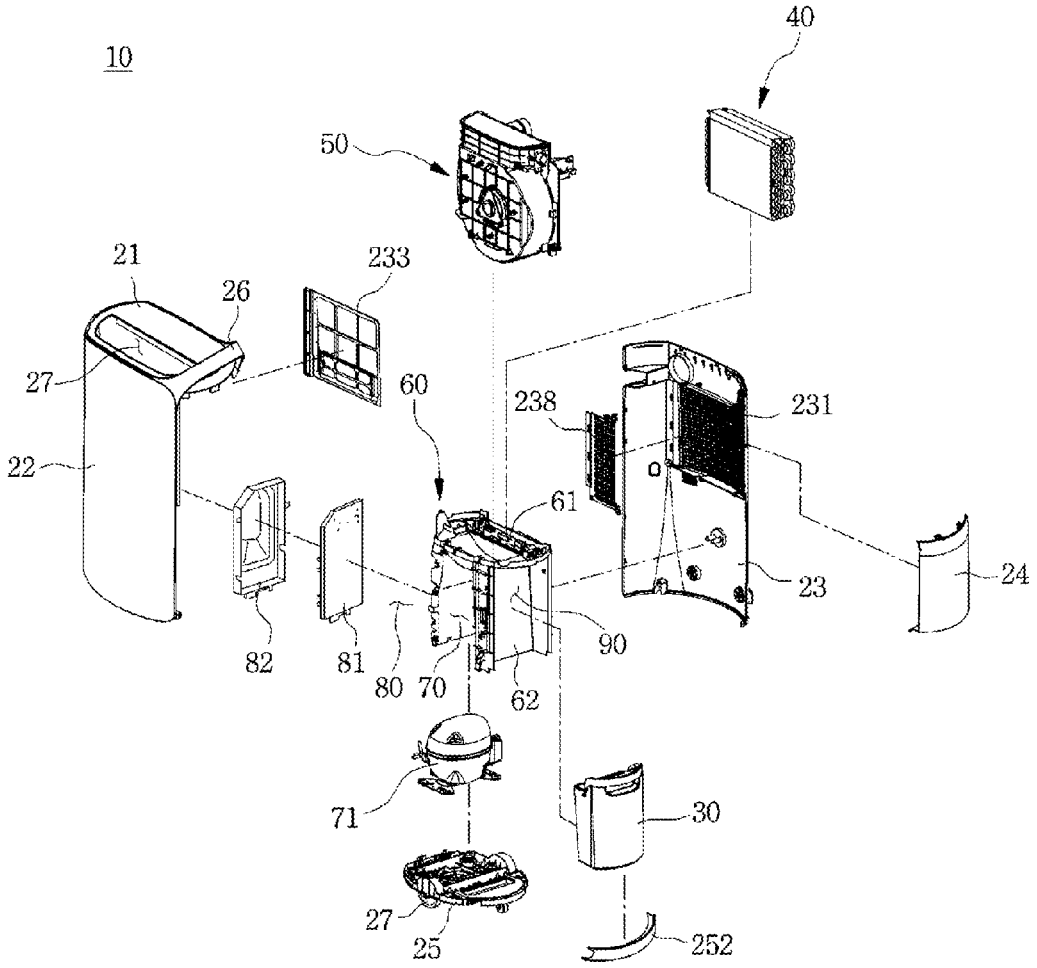
FIG. 3 is an exploded perspective view illustrating inner constitutions of the dehumidifier according to an embodiment.

FIG. 1 is a front perspective view illustrating an outer appearance of a dehumidifier according to an embodiment. FIG. 2 is a rear perspective view illustrating the outer appearance of the dehumidifier according to an embodiment. FIG. 3 is an exploded perspective view illustrating inner constitutions of the dehumidifier according to an embodiment.

Referring to FIGS. 1 to 3, a dehumidifier 10 may include a main body 20 that defines an outer appearance of the dehumidifier 10. The main body 20 may include an upper panel 21 defining an outer appearance of a top surface, a front panel 22 defining an outer appearance of a front surface, a rear panel 23 defining an outer appearance of a surface facing the front panel 22, a side panel 24 defining a portion of an outer appearance of a right surface, and a base 25 defining an outer appearance of a bottom surface. The rear panel 23 may include an inflow hole 231 for air outside the main body 20 to be introduced into the main body 20.

The main body 20 may be formed of a material having strength above a predetermined level to protect a plurality of components mounted in an inner space against an external impact.

An upper handle 26, to be grasped by a user when the user intends to move the main body 20 to a desired space, may protrude from an upper portion of the main body 20. A wheel 27, for easily moving the main body 20 when the user intends to move the main body 20 in the state where the user grasps the upper handle 26, may be mounted on the base 25.

One end of the upper handle 26 may be disposed on an edge portion at which an upper end of the front panel 22 and a front end of the upper panel 21 meet each other. The other end of the upper handle 26 may be disposed on an edge portion at which an upper end of the rear panel 23 and a rear end of the upper panel 21 meet each other. The upper handle 26 may have a bar shape that is rounded in an arch shape so that a central portion of the upper handle 26 has an upward convexly curved surface.

Since the upper handle 26 is coupled to the upper panel 21, the front panel 22, and the rear panel 23 to form the arch shape, a user may easily grasp the upper handle 26.

The upper handle 26 is not limited to the above-described shape. For example, the upper handle 26 may have various shapes that are capable of being easily grasped by the user.

The upper handle 26 may be disposed at a position that is adjacent to a detachment surface of the water tank 30, as will be described below. Since the upper handle 26 is disposed on an upper edge portion of the main body 20, which is adjacent to a position at which the water tank 30 is disposed, the user may confirm a water level of the water tank 30 when the user grasps the upper handle 26 to move the dehumidifier 10.

A discharge hole 211, through which air within the main body 20 is discharged to the outside, may be defined in the upper panel 21 of the main body 20. A second discharge hole 232 may be further defined in an upper portion of the rear panel 23 as a unit for discharging the air within the main body 20 to outside in addition to the discharge hole 211. A discharge accessory may be coupled to the second discharge hole 232 so that dehumidified air is discharged through the discharge accessory.

A cap may be mounted on the second discharge hole 232 to selectively open or close the second discharge hole 232. Thus, when the second discharge hole 232 is not used, the second discharge hole 232 may be covered by the cap. On the other hand, when the second discharge hole 232 is used, the cap may be separated from the second discharge hole 232 to open the second discharge hole 232.

The discharge accessory may include a shoe drying accessory for drying shoes and/or a wardrobe drying accessory for drying a wardrobe.

When the discharge accessory is coupled to the second discharge hole 232, dehumidified air discharged from the second discharge hole 232 may be guided by the discharge accessory and then discharged into a space in which the dehumidification is required.

However, configurations and positions of the inflow hole 231 and the discharge hole 211 are not limited to the accompanying drawings.

A louver 211*a* is mounted on the discharge hole 211 defined in the upper panel 21 to open or close the discharge hole 211 as well as adjust a discharge direction of air that is discharged from the main body 20 to an external space. A control panel 211*b* including a power button for turning a power of the dehumidifier 10 on/off, a manipulation unit for manipulating an operation of the dehumidifier 10 by the user, and a display unit for displaying operation information of the dehumidifier 10 or the present humidity may be disposed at any position of the upper panel 21, which is spaced apart from the discharge hole 211.

The user may select desired humidity through the manipulation unit. When the user sets a desired humidity, a control unit may compare the present humidity to the set humidity to control operations of a compressor and a fan assembly.

For example, when it is determined that the present humidity approaches the humidity desired by the user, operation of the compressor is stopped. Additionally, the fan assembly may be maintained to a low fan rotation rate or stopped.

The inflow hole 231 (defined in the rear panel 23) may have a grill shape to prevent a foreign substance having a relatively large size from being introduced into the inner space of the main body 220. An air filter 233 for filtering foreign substances contained in air passing through the inflow hole 231 may be further mounted at the inflow hole 231.

A humidity sensor 234, for detecting humidity of a space in which the dehumidifier 10 is installed, may be further mounted on the rear panel 23. The humidity detected by the humidity sensor 234 may be transmitted to the user through the display unit.

A power code unit 235 may be disposed on the rear panel 23. The power code unit 235 may include a code fixing part 236 around which a power code for supplying a power into the main body 20 is wound and a code insertion part 237 in which the power code is temporarily inserted and fixed.

The user may cleanly arrange and store the power code through the power code unit 235 when the dehumidifier 10 is not used. For example, limitations in which the power code contacts a bottom in a state where the power code is unwound, or movement of the dehumidifier is restricted by an obstacle when the dehumidifier 10 is moved may be solved.

The air filter 233, mounted on the inflow hole 231, may have a mash shape to filter foreign substances contained in the air passing through the inflow hole 231 so that only clean air from which the foreign substances are removed is introduced into the inner space of the main body 20.

The air filter 233 may be inserted and mounted into the main body 20. The user may withdraw the air filter 233 to wash and dry the air filter 233 so as to reuse the air filter 233.

A filter guide 238 for guiding insertion/withdrawal of the air filter 233 may be further disposed on the rear panel 23. The filter guide 238 may extend laterally in a state where the filter guide 238 is spaced a predetermined distance from the inflow hole 231 on the front surface of the rear panel 23 in which the inflow hole 231 is defined.

The air filter 233 may be inserted into or withdrawn from the inner space of the main body 20 through a gap defined between the filter guide 238 and the inflow hole 231. Since the filter guide 238 extends laterally, even though a portion of the human body or foreign substance is inadvertently or mistakenly inserted or introduced into the space in which the air filter 233 is inserted, introduction of the foreign substance into the main body 20 may be prevented by the filter guide 238.

A hole in which the air filter 233 is inserted may be defined in an edge of a side (an edge of a right side in FIG. 2) of the inflow hole 231. Thus, the air filter 233 may be inserted toward an edge of a left side of the inflow hole 231. That is to say, the air filter 233 is not inserted from the rear panel 23 toward the front panel 222, but is inserted from the edge of the right side of the inflow hole 231 toward the edge of the left side of the inflow hole 231. Thus, the air filter 233 and the rear panel 23 may be parallel to each other.

The base 25 (defining the outer appearance of the bottom surface) may be mounted on a lower end of the rear panel 23. The side panel 24 (defining a portion of the outer appearance of the side surface) may be mounted on ends of right sides of the front panel 22 and the rear panel 23.

A water tank 30, for receiving condensed water generated while air is dehumidified, may be mounted on a lower portion of the side panel 24. A portion of the outer appearance of the side surface of the main body 20 may be defined by the water tank 30. The water tank 30 may be described below in detail.

A heat exchange unit 40 heat-exchanged with air introduced through the inflow hole 231 and a fan assembly 50 for forcibly blowing air within the main body 20 are mounted in the inner space of the main body 20.

A frame 60 for supporting the heat exchange unit 40 and the fan assembly 50 is disposed under the heat exchange unit 40 and the fan assembly 50. A compression chamber 70, in which a compressor 71 for compressing a refrigerant is accommodated, is defined in a central portion of the frame 60. An electronic component chamber 80, in which electronic components are mounted, is defined in one side of left and right sides of the compression chamber 70. A water tank chamber 90 (in which the water tank 30 is accommodated) is defined at the other side.

The air passing through the heat exchange unit 40 is heat-exchanged with the refrigerant flowing through the heat exchange unit 40 to decrease in temperature. As a result, moisture contained in the air may be condensed to change into a dried state.

The fan assembly 50 for forcibly blowing the air within the main body 20 is mounted on one side of the heat exchange unit 40. As the fan assembly 50 rotates, external air may be forcibly introduced into the main body through the inflow hole 231. The introduced air may be dehumidified while passing through the heat exchange unit 40. The dehumidified air is discharged to an external space through the discharge hole 211.

The frame 60 is disposed under the heat exchange unit 40 and the fan assembly 50, and the heat exchange unit 40 and the fan assembly 50 are supported by a top surface of the frame 60.

The frame 60 may include an upper frame 61 supporting the heat exchange unit 40 and the fan assembly 50, and a lower frame 62 partitioning a lower space of the upper frame 61 into the compression chamber 70, the electronic component chamber 80, and the water tank chamber 90.

The upper frame 61 may be divided into a portion for supporting the fan assembly 50 and a portion for supporting the heat exchange unit 40.

The portion of the upper frame 60, which supports the heat exchange unit 40, may serve as a drain fan for draining the condensed water that drops down from the heat exchange unit 40. A top surface of the portion of the upper frame 80, which supports the heat exchange unit 40, may have a predetermined inclination to allow the condensed water dropping down from the heat exchange unit 40 to be collected into a predetermined position.

The water collected by the inclination of the top surface of the upper frame 61 may be guided to a top surface of the water tank 30 to drop down. The water dropping into the water tank 30 is stored in the water tank 30.

A lower side of the inner space of the main body 20 may be divided into the electronic component chamber 80, the compression chamber 70, and the water tank chamber 90 by the lower frame 62. The electronic component chamber 80, the compression chamber 70, and the water tank chamber 90 may be arranged in a line. Thus, the main body 20 may be slim to improve aesthetic sensibility of the dehumidifier 10. That is, the main body 20 may have a thin width in a front/rear direction and a relatively long width in a left/right direction to realize slimness of the dehumidifier 10.

An upper end of the lower frame 62 may support the upper frame 61, and a lower end of the lower frame 62 may be supported by the base 25.

Since the lower frame 62 is mounted across in a front/rear direction of a space that is defined by the front panel 22 and the rear panel 22, the lower side of the inner space of the main body 20 may be partitioned into three spaces in the left/right direction of the main body 20.

When the upper frame 61 and the lower frame 62 are viewed from a front side, each of the upper frame 61 and the lower frame 62 may have an approximately "e of the iThe heat exchange unit 40 and the fan assembly 50 may be disposed at an upper side, and the electronic component chamber 80, the compression chamber 70, and the water tank chamber 90 may be disposed at a lower side. Thus, the electronic component chamber 80 and the water tank chamber 90 are disposed at left and right sides with respect to the compression chamber 70 by the frame 60, respectively.

The compressor 71 for compressing the refrigerant flowing through the heat exchange unit 40 is mounted in the compression chamber 70. A plurality of electronic components may be mounted in the electronic component chamber 80. For example, a main board 81 for controlling the plurality of electronic components may be mounted in the electronic component chamber 80, and a control case 82 for protecting the main board 81 against an external impact may be curved on the main board 81.

The main board 81 may be accommodated in the control case 82, and an opposite side of the control case 82 is covered by a control cover to protect the main board 81 against the external impact.

Figure 4:
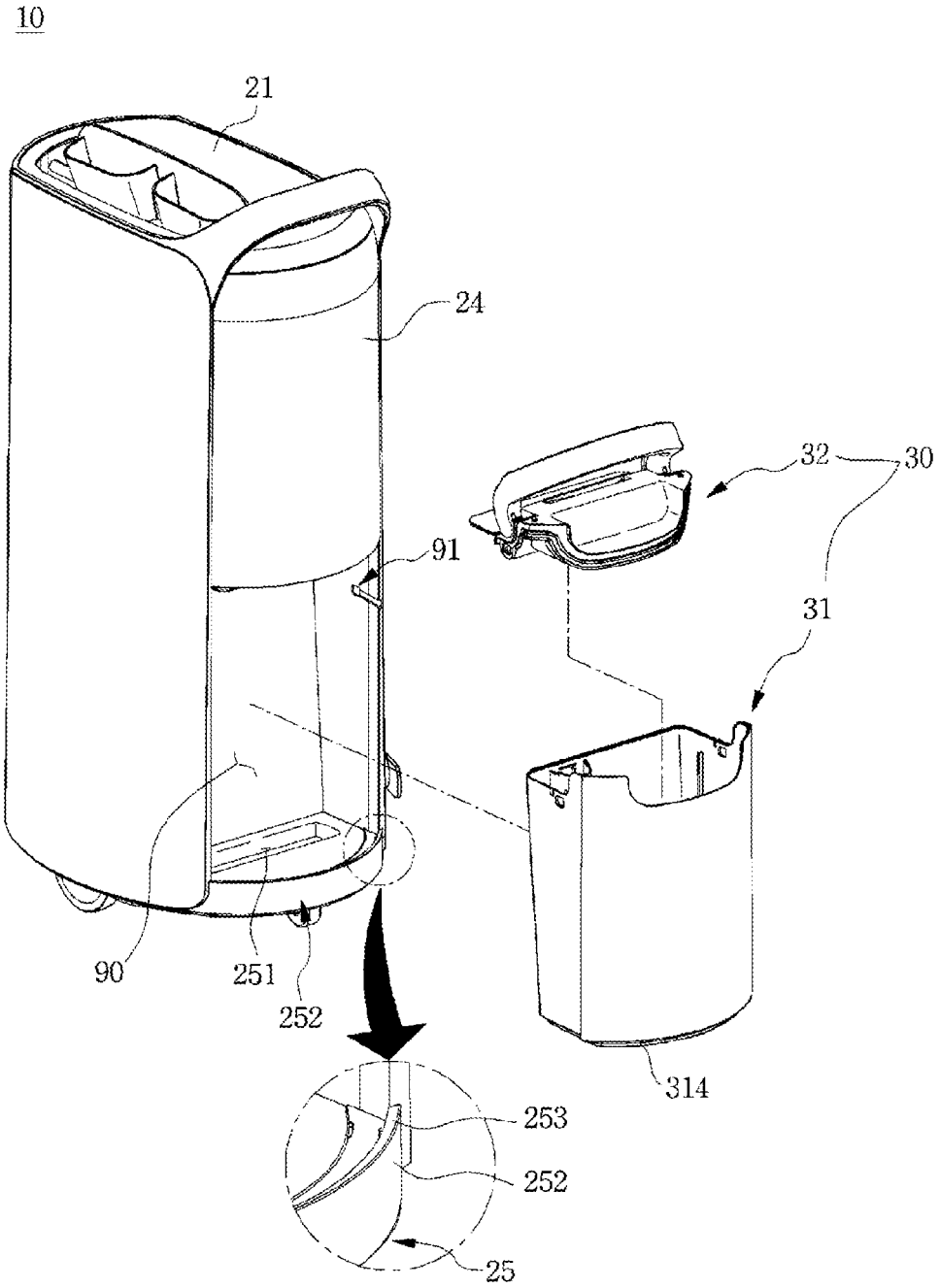
FIG. 4 is a front perspective view illustrating a state in which a water tank of the dehumidifier is separated according to an embodiment.
Figure 5:
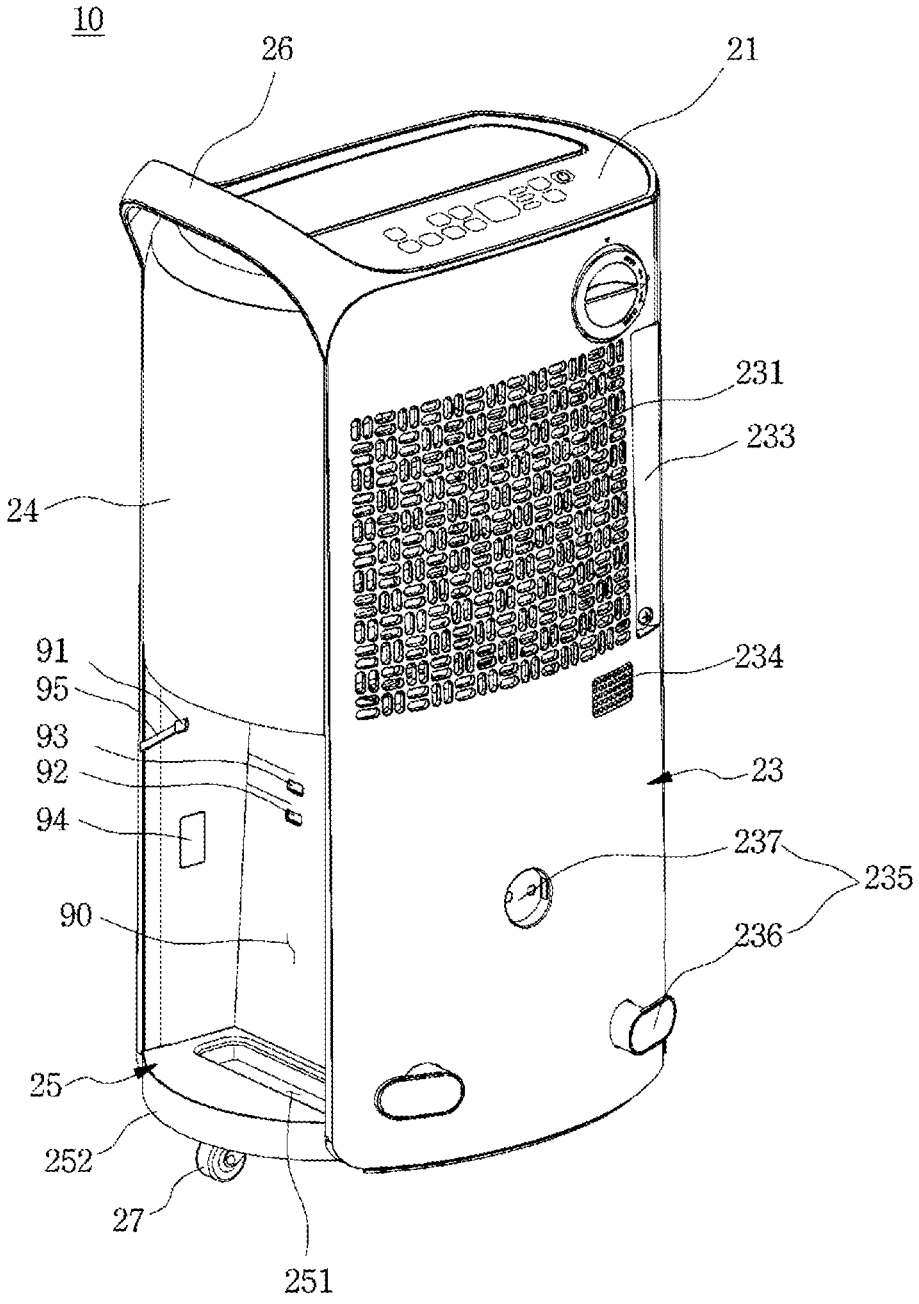
FIG. 5 is a rear perspective view illustrating a state in which the water tank of the dehumidifier is separated according to an embodiment.

FIG. 4 is a front perspective view illustrating a state in which the water tank of the dehumidifier is separated according to an embodiment. FIG. 5 is a rear perspective view illustrating a state in which the water tank of the dehumidifier is separated according to an embodiment.

Referring to FIGS. 4 and 5, the water tank 30 is mounted in the water tank chamber 90. When viewed from a front side, the water tank chamber 90 may have a side surface having an opened hexahedral shape. Thus, the water tank 30 may be detachable in a later direction of the main body 20 through the opened side surface.

A bottom surface of the water tank chamber 90 may be defined by the base 25, and a surface of the water tank chamber 90 except for the opened side surface may be defined by the lower frame 62. A coupling groove 91 for mounting the water tank 30 is defined in an inner surface of the water tank chamber 90. A light emitting part 94 for irradiating light toward the water tank 30, a water level detection sensor 92, and a safety sensor 93 may be mounted on the inner surface of the water tank chamber 90.

Only the water level sensor 92 may be mounted in the water tank chamber 90, and the safety sensor 93 may not be mounted in the water tank chamber 90. However, for improving safety, the safety sensor 93 may be provided.

The water level sensor 92 may detect a position of a movable member 311 that is disposed in the inner space of the water tank 30 to detect a water level of the water tank 30. When a full level of the water tank 30 is detected, the safety sensor 93 may transmit the full level information to the control unit to control an operation of the dehumidifier 10.

As an end of a coupling module (reference numeral 35 of FIG. 6) is inserted into the coupling groove 91, the water tank 30 is fixed. Since a portion of the coupling module 35 is inserted into the coupling groove 91, a random separation of the water tank 30 may be prevented.

That is, a portion of the coupling module 35 may be inserted into the coupling groove 91 and then mounted. When the coupling module 35 is separated from the coupling groove 91 by an external force of the user, the water tank 30 may be separated from the water tank chamber 90.

A guide part 95 for guiding the portion of the coupling module 35, which is inserted into the coupling grove 91, when the user separates or mounts the water tank 30 is further disposed on the side surface of the water tank chamber 90.

The guide part 95 may have a predetermined space by laterally recessed from the side surface of the water tank chamber 90 to guide a portion of the coupling module 35. In one example, the guide part 95 may be defined as a slit that is formed by cutting the side surface of the water tank chamber 90.

The guide part 95 may have a predetermined curvature to guide movement of the coupling module 35. Alternatively, the guide part 95 may have a predetermined inclination to guide movement of the coupling module 35.

Since the frame 60 surrounds an upper portion and both side portions of the compressor 71, noise generated from the compressor 71 may be reduced.

A base groove 251, for receiving the condensed water dropping in the state where the water tank 30 is separated, may be defined in the bottom surface of the water tank chamber 90 (i.e., a top surface of the base 25 that is disposed under the water tank 30 to support the water tank 30).

The base groove 251 may have a predetermined area and may be recessed downward to collect the condensed water dropping in the state where the water tank 30 is separated from the main body 20. Thus, the structure of the base groove 251 may prevent the condensed water from leaking to outside of the main body 20.

As described above, since leakage of the condensed water to the outside of the main body 20 is prevented by the base groove 251, use convenience of the dehumidifier 10 may be more improved. Since the leakage of the condensed water into the external space of the main body 20, it may prevent the indoor space from being contaminated.

A deco panel 252 may be mounted on a side surface of the base 25. The deco panel 252 may be coupled to a lower end of the water tank 30 and may define a lower end of a right surface of the main body 20.

The deco panel 252 may be rounded with a curvature corresponding to that of the side surface of the base 25, and may be detachably mounted on the side surface of the base 25. A restriction rib 253 for restricting movement of a lower end of the water tank 30 may extend upward from an edge of an upper end of the deco panel 252.

A stepped portion 314, having a shape corresponding to that of the restriction rib 253, may be disposed on an edge of a lower end of the water tank 30. The edge of the lower end of the water tank 30 may be bent toward the inner space to form the stepped portion 314.

The restriction rib 253 may be coupled to match the stepped portion 314 to restrict lateral movement of the lower end of the water tank 30.

Constitutions of the water tank 30 detachably mounted on the main body 20 may be described with reference to FIGS. 6 to 14.

Figure 6:
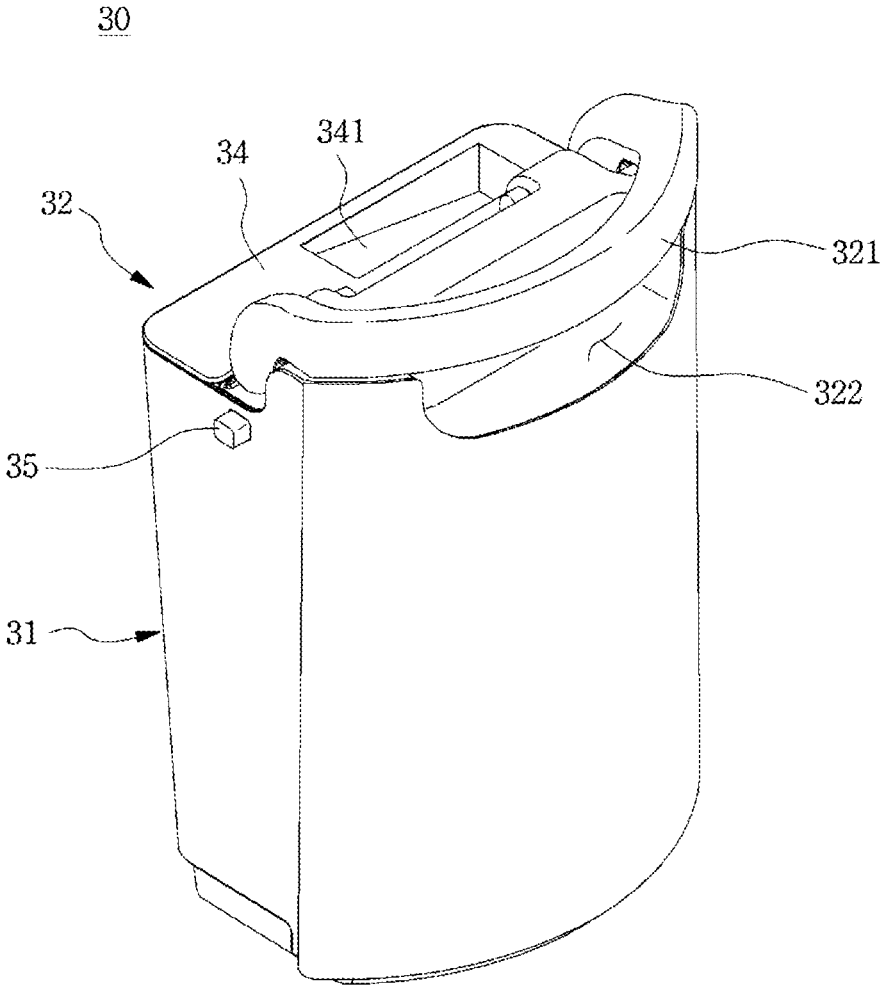
FIG. 6 is a front perspective view illustrating the water tank of the dehumidifier according to an embodiment.
Figure 7:
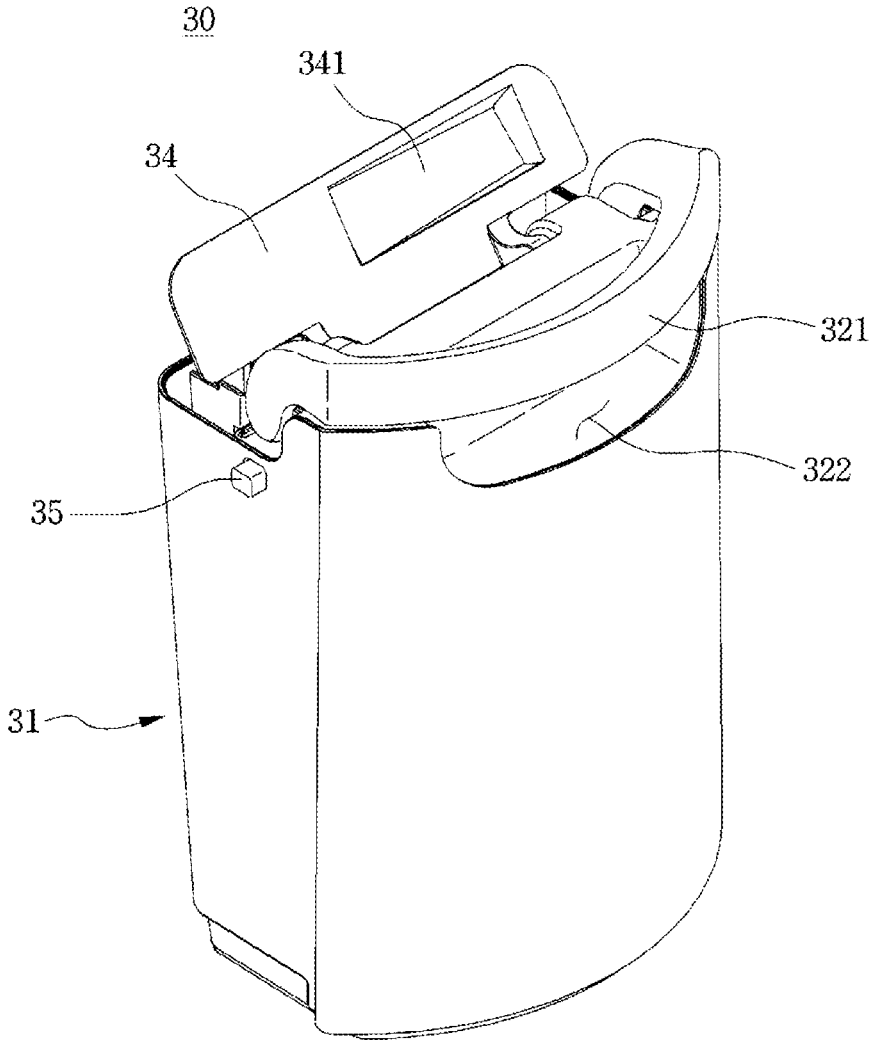
FIG. 7 is a front perspective view illustrating a state in which a portion of a water tank cover of the dehumidifier is opened according to an embodiment.

FIG. 6 is a front perspective view illustrating the water tank of the dehumidifier according to an embodiment. FIG. 7 is a front perspective view illustrating a state in which a portion of a water tank cover of the dehumidifier is opened according to an embodiment.

Figure 8:
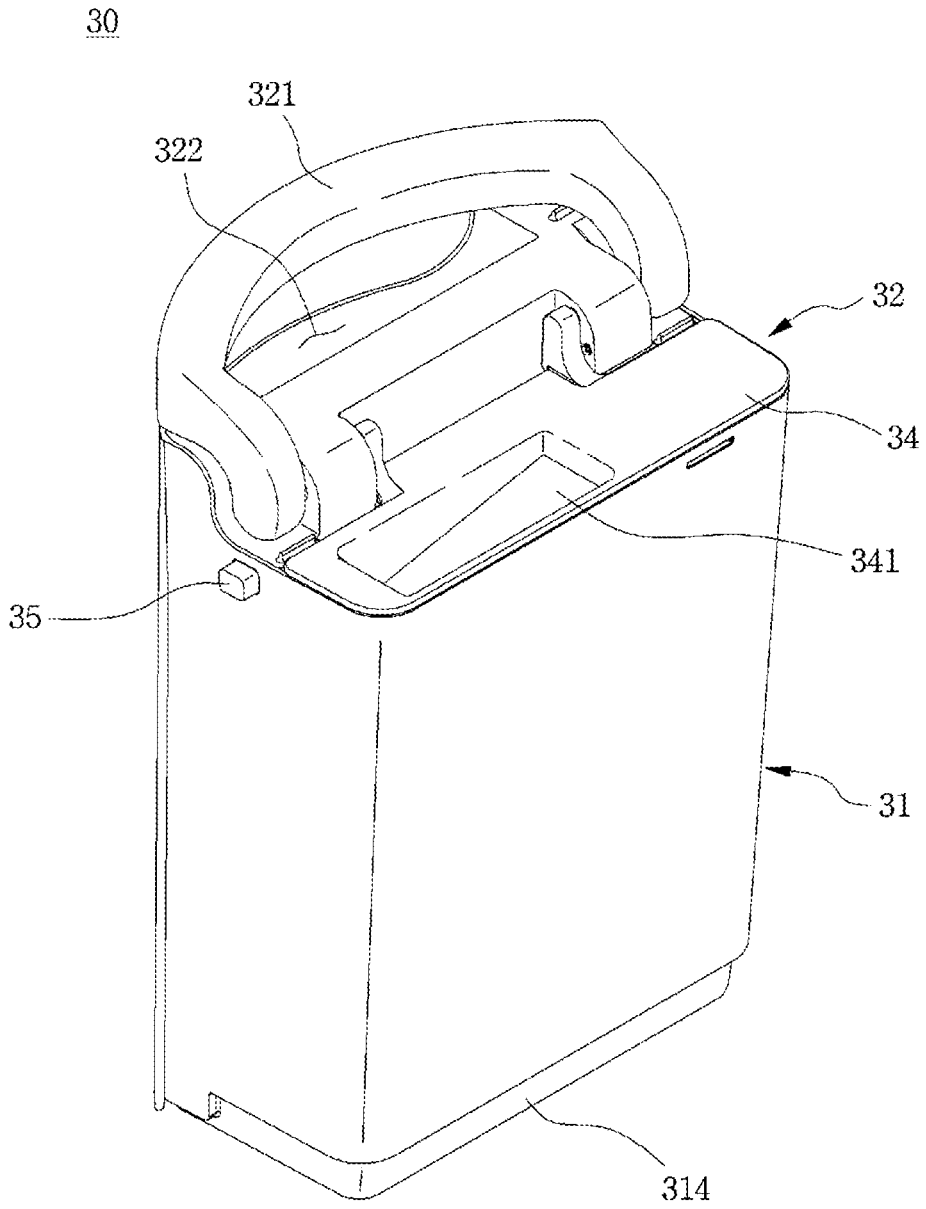
FIG. 8 is a rear perspective view illustrating the water tank of the dehumidifier according to an embodiment.
Figure 9:
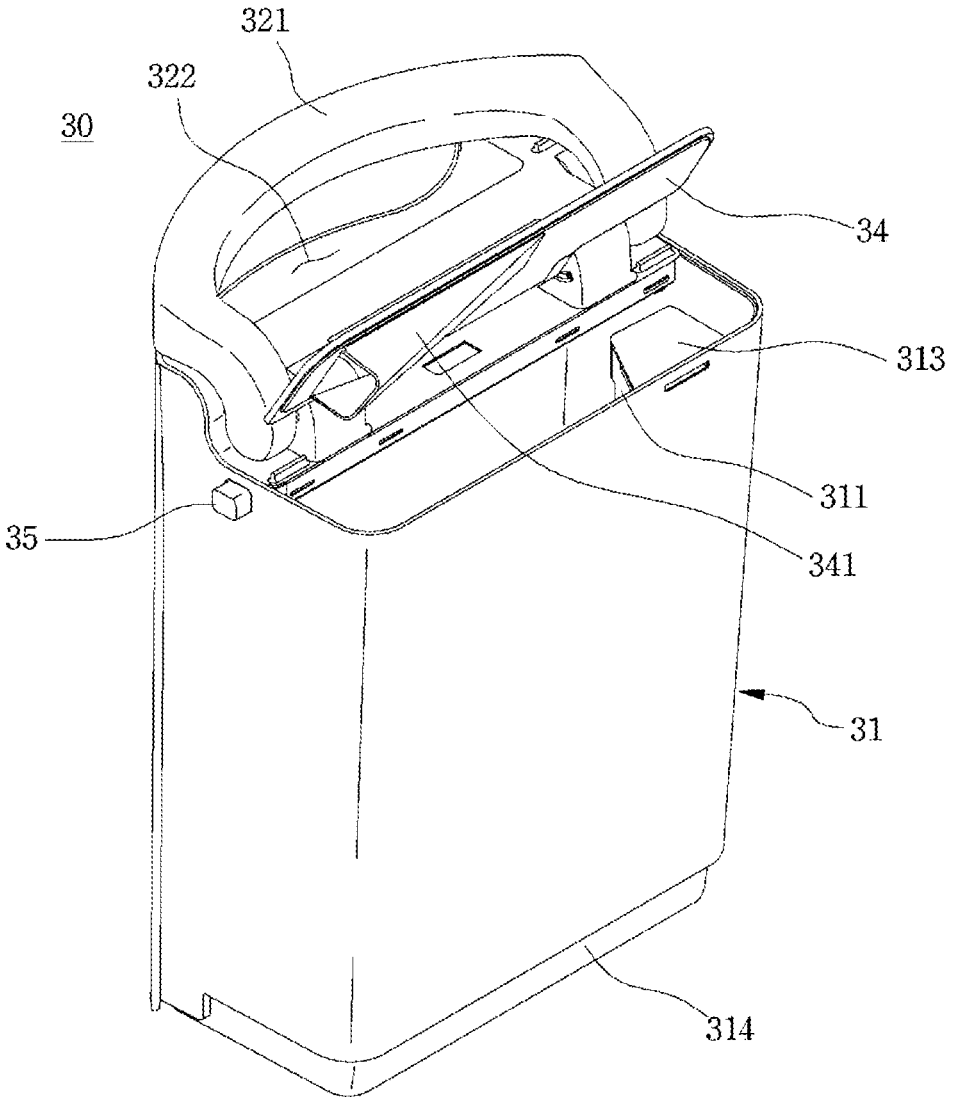
FIG. 9 is a rear perspective view illustrating the state in which a portion of the water tank cover of the dehumidifier is opened according to an embodiment.

FIG. 8 is a rear perspective view illustrating the water tank of the dehumidifier according to an embodiment. FIG. 9 is a rear perspective view illustrating the state in which a portion of the water tank cover of the dehumidifier is opened according to an embodiment.

Figure 10:
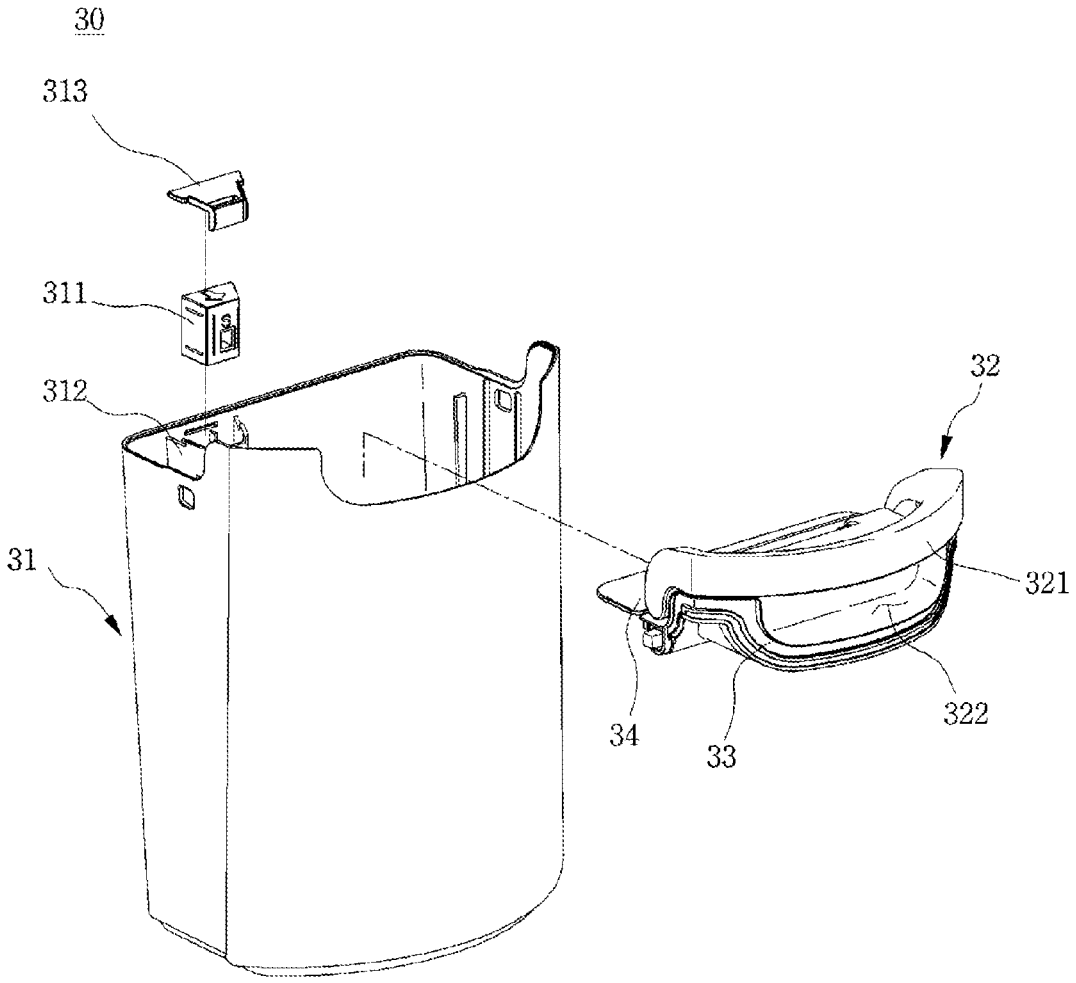
FIG. 10 is an exploded perspective view illustrating the water tank of the dehumidifier according to an embodiment.
Figure 11:
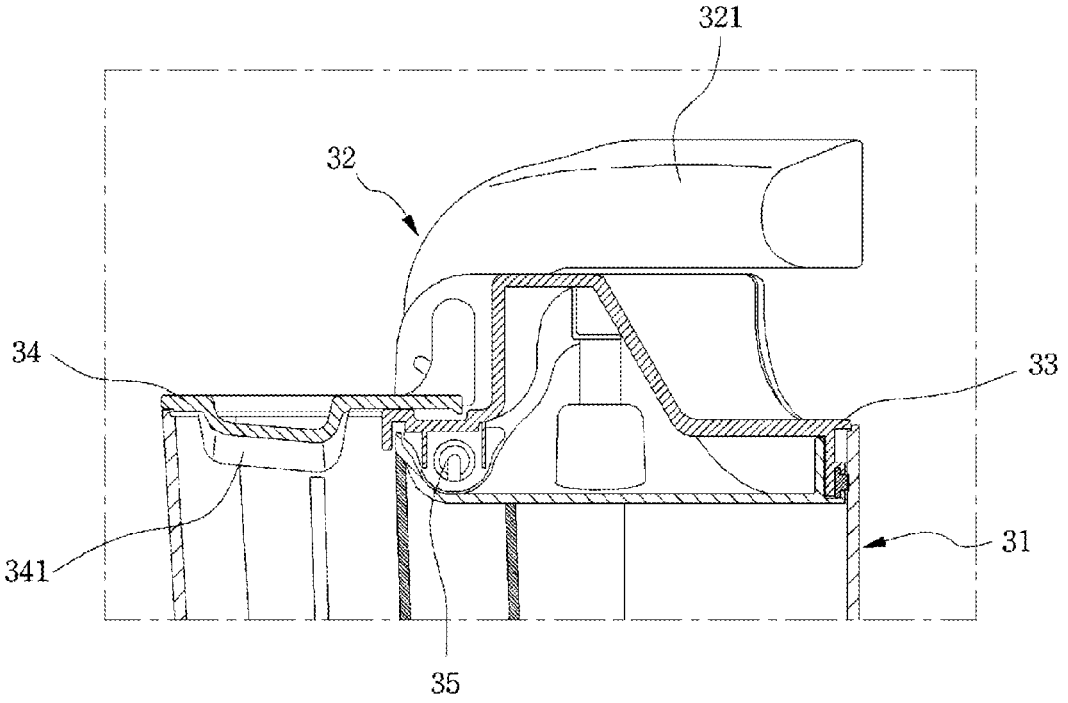
FIG. 11 is a partial cross-sectional view illustrating a portion of the water tank of the dehumidifier according to an embodiment.

FIG. 10 is an exploded perspective view illustrating the water tank of the dehumidifier according to an embodiment. FIG. 11 is a partial cross-sectional view illustrating a portion of the water tank of the dehumidifier according to an embodiment.

Figure 12:
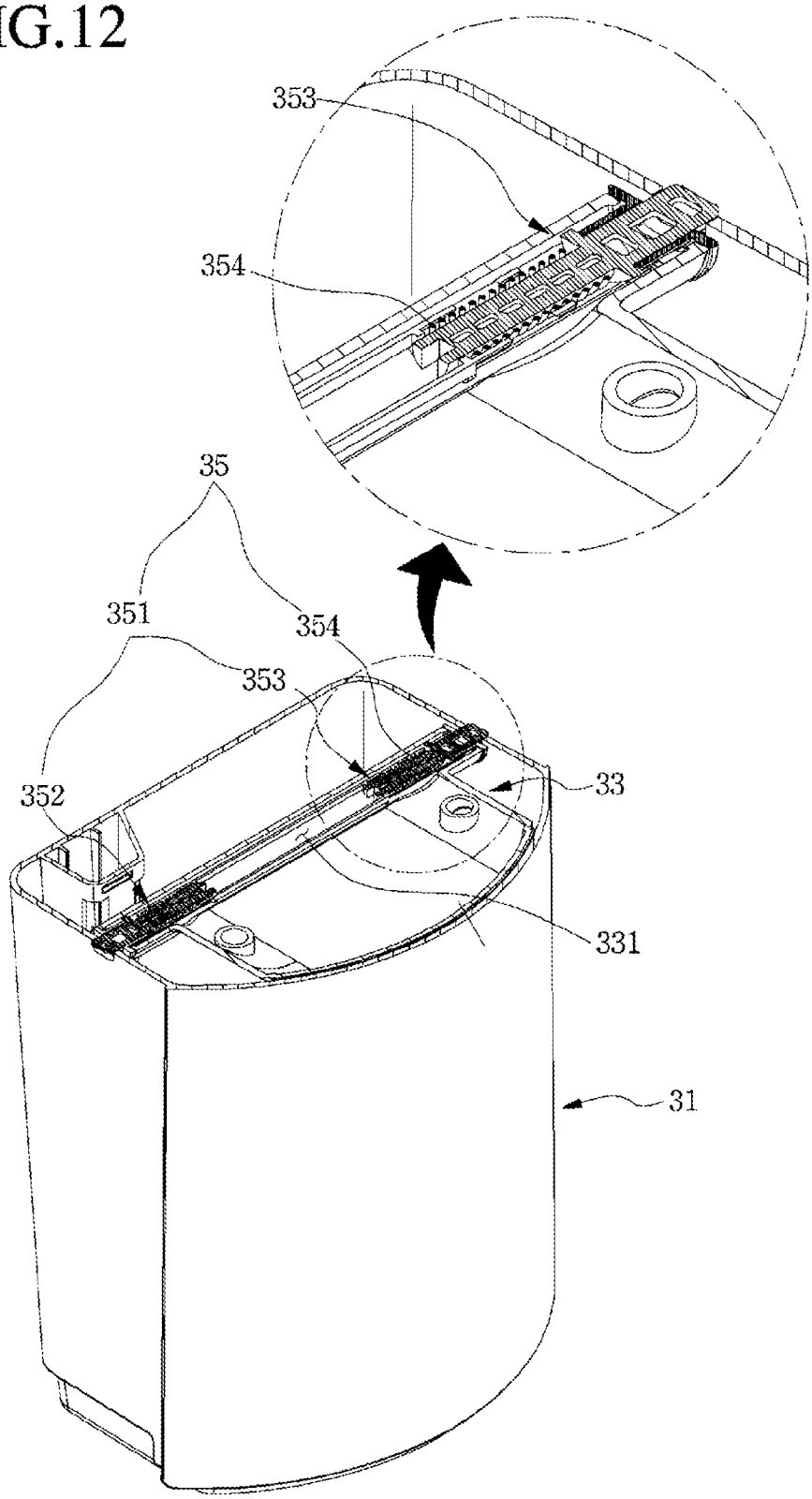
FIG. 12 is a partial cross-sectional view illustrating a portion of the water tank of the dehumidifier when viewed in a different direction according to an embodiment.
Figure 13:
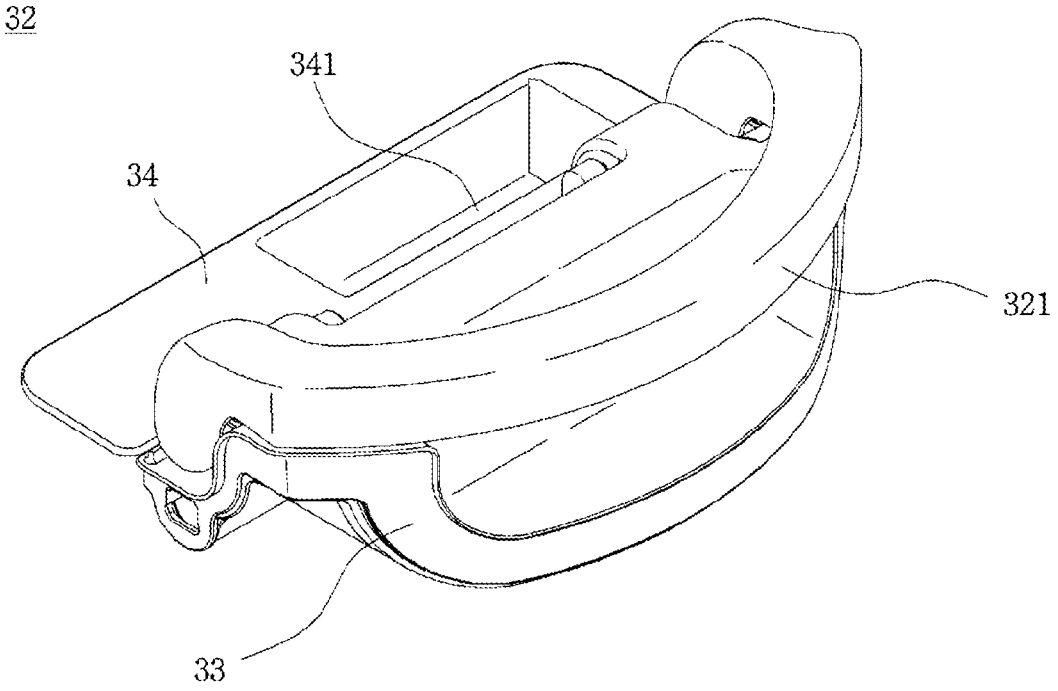
FIG. 13 is a perspective view illustrating the water tank cover of the dehumidifier according to an embodiment.

FIG. 12 is a partial cross-sectional view illustrating a portion of the water tank of the dehumidifier when viewed in a different direction according to an embodiment. FIG. 13 is a perspective view illustrating the water tank cover of the dehumidifier according to an embodiment.

Figure 14:
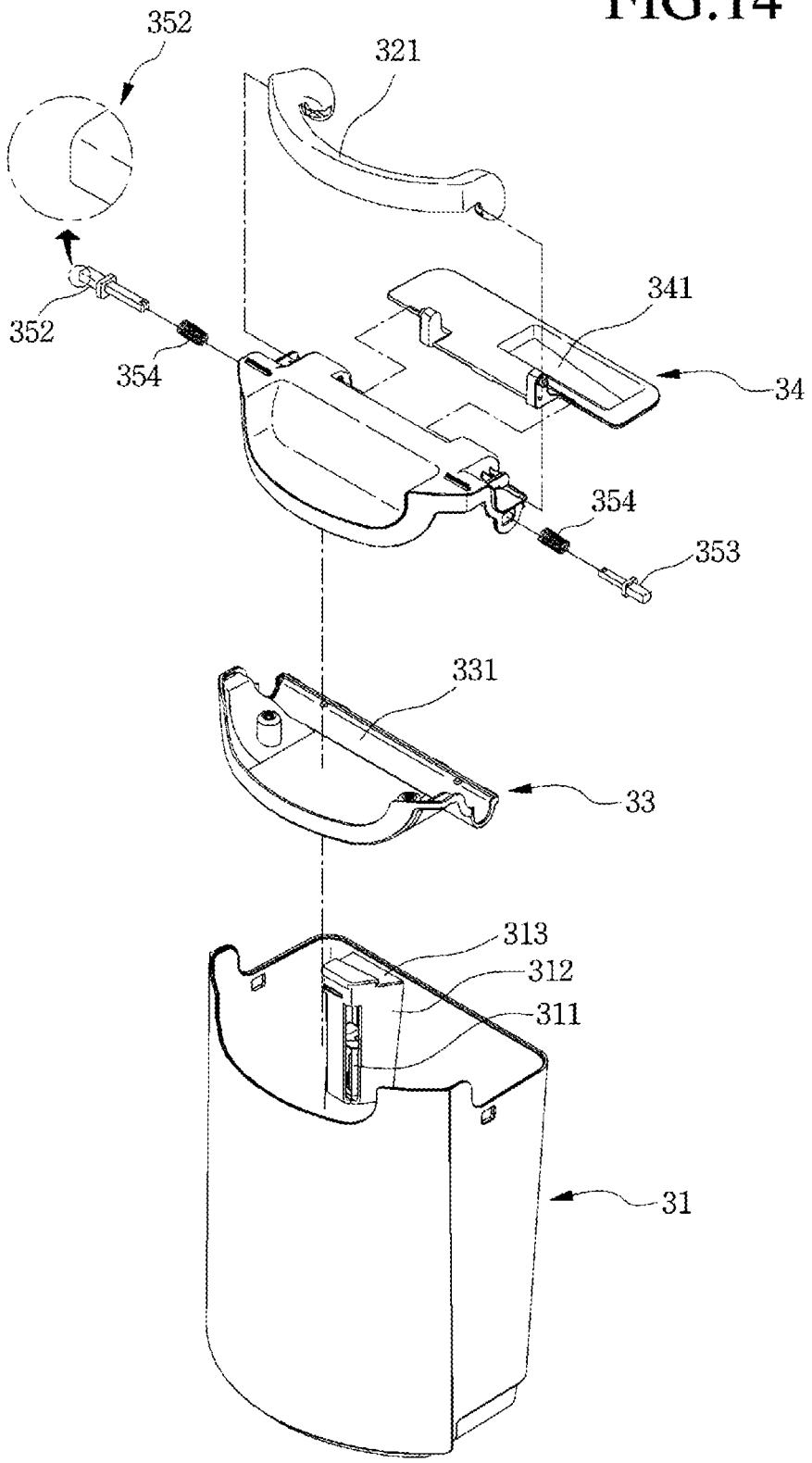
FIG. 14 is an exploded perspective view illustrating the water tank of the dehumidifier according to an embodiment.

FIG. 14 is an exploded perspective view illustrating the water tank of the dehumidifier according to an embodiment.

Referring to FIGS. 6 to 14, the water tank 30 may be mounted on a lower portion of the side panel 24. An outer circumferential surface of the water tank 30 may define a portion of the outer appearance of the side surface of the main body 20.

The water tank 30 may be detachably mounted in a lateral direction with respect to the rear panel 23, and may have a hexahedral shape with a predetermined inner space.

The water tank 30 may be formed of a transparent or translucent material so that the user confirms a level of water filled in the water tank 30. An amount of water filled in the water tank 30 may be confirmed through other methods. For example, although the water tank 30 is formed of the transparent or translucent material in at least one embodiment, a water level may be estimated by detecting a variation in weight of the water tank 30. A weight sensor, for detecting a weight of the water tank 30, may be mounted on the base 25.

The water tank 30 may include a case 31 having an opened top surface and a space for receiving condensed water generated from the heat exchange unit 40, a cover 32 for opening/closing the opened top surface of the case 31, and a coupling module 35 for selective coupling of the cover 32 and the case 31 and selective coupling of the main body 20 and the case 31.

A surface of the case 31, defining a portion of the outer surface of the main body 20, may be rounded with a curvature corresponding to that of the side panel 24 to define an outer appearance of a lower portion of the side panel 24.

The cover 32 may open or close the opened top surface of the case 31. The cover 32 may be provided with at least two portions. A tank handle 321, to be grasped by the user, may be mounted on the cover 32. An outer surface of the tank handle 321 may define a portion of the side surface of the main body 20, as shown in FIGS. 1 and 2. That is to say, the outer surface of the tank handle 321 may be disposed between the lower end of the side panel 24 and the upper end of the water tank 30 to define a portion of the side surface of the main body 20.

A grasping groove 322, configured to allow the user to easily grasp the tank handle 321 when the water tank 30 is detached, may be defined in a side of the outer surface of the water tank 30. When the tank handle 321 is grasped to clean the water tank 30 or empty the water tank 30 filled with water, an inference between a back of user's hand and the water tank 30 may be prevented by the grasping groove 322 to improve use convenience. Since the user's hand is disposed in the grasping groove 322, the water tank 30 may be easily tilted to discard the condensed water.

The cover 32 may be divided into at least two portions. More specifically, the cover 32 may include a coupling cover 33 selectively detachable to a top surface of the case 31 and a drain cover 34 rotatably mounted on the coupling cover 33.

The drain cover 34 may be rotatably coupled to the coupling cover 33 to open a portion of the top surface of the case 31. The other portion of the top surface of the case 31 may be selectively opened or closed by the coupling cover 33.

When the user leans the water tank 30 in the state where the user grasps the tank handle 321 to discard the condensed water filled in the case 31, the drain cover 34 may rotate with respect to the coupling cover 33 to open a portion of the top surface of the water tank 30. The condensed water may then be drained through the opened portion of the top surface of the water tank 30.

As described above, the user may rotate the drain cover 34 to open a portion of the top surface of the water tank 30. The coupling cover 33 may be separated from the top surface of the case 31 to open the whole top surface of the water tank 30.

A condensed water guide part 341 having a predetermined area and recessed downward may be defined in the top surface of the drain cover 34. The condensed water dropping from the heat exchange unit 40 may be collected into the upper frame 61. The condensed water collected into the upper frame 61 to drop may then drop into the case 31 through the condensed water guide part 341.

The condensed water guide part 341 may be recessed downward from a top surface of the drain cover 34 to define a recessed space having a predetermined size. A bottom surface of the condensed water guide part 341 may be tilted at a predetermined angle in a direction of the side surface of the case 31. Thus, the condensed water dropping into the condensed water guide part 341 may flow along the tilted bottom surface of the condensed water guide part 34 to drop into the inner space of the case 31. A condensed water hole may be defined in an edge of the lowest bottom of the condensed water guide part 341, and the condensed water may be guided to the condensed water guide part 341 and then collected into the case 31.

The upper frame 61 is disposed above the condensed water guide part 341, and the heat exchange unit 40 is provided on the upper frame 61. A portion of the upper frame 61 that performs a function of a drain pan may be disposed above the condensed water guide part 341. The condensed water dropping from the heat exchange unit 40 may be guided to the condensed water guide part 341 via the upper frame 61. Thus, the condensed water collected while flowing in a predetermined direction by inclination of the upper frame 61 may drop into the condensed water guide part 341. The condensed water may flow by the inclination of the condensed water guide part 341 to drop into the inner space of the case 31.

A sensor room 312 may be defined in the case 31. A movable member 311, which is vertically movable according to a water level of the condensed water collected into the case 31 may be mounted in the sensor room 312. For example, a floater may be used as the movable member 311.

The sensor room 312 may protrude from an inner circumferential surface of the case 31 to form a predetermined space. A bottom part of the sensor room 312 may communicate with the inner space of the case 31. That is, the condensed water collected into the case 31 may be introduced into the sensor room 312 to float the movable member 311.

The movable member 311 may be vertically movable only within the sensor room 312 and may also be vertically movable according to a water level.

When a water level of the condensed water increases in the inner space of the case 31, the condensed water may be introduced through the opened bottom surface of the sensor room 313, and thus the movable 311 may ascend or descend in the sensor room 312 according to the water level of the introduced condensed water.

The top surface of the sensor room 312 may be selectively opened or closed by a room cover 313. The room cover 313 may prevent the movable member 311 from being separated to outside through the top surface of the sensor room 312.

The movable member 311 may be a floater having predetermined magnetism. That is, a magnet may be mounted within the floater, and a hall sensor may be mounted on a vertical wall of the sensor room 312 to detect a water level within the case 31 by detecting a position of the floater. The movable member 311 may be formed of a material having self-magnetism.

The water tank 30 may be detachable in a lateral direction with respect to the rear panel 23. As described above, since the water tank 30 is detachably mounted in the later direction with respect to the rear panel 23, the main body 20 may be slim in the front/rear direction.

As shown in FIGS. 11 and 12, the coupling module 35 for coupling the drain cover 34 to the coupling cover 33 may be mounted on the cover 32. The coupling module 35 may be disposed on the coupling cover 33 and may have both ends respectively passing through both side surfaces of the coupling cover 33.

Both ends of the coupling module 35 may pass through both side surfaces of the coupling cover 33 and then pass through both side surfaces of the case 31, respectively. Both ends of the coupling module, which pass through both side surfaces of the case 31, may be accommodated into the coupling groove 91 to prevent the water tank from being randomly separated.

As described above, the coupling module 35 may be configured to allow the main body 20 and the water tank 30 to be selectively coupled to each other as well as allow the case 31 and the cover 32 to be selectively coupled to each other.

The coupling module 35 may include a coupling rod 351 seated on a module seat part 331 defined in the top surface or inside the coupling cover 33 and an elastic body 354 fitted into an outer circumferential surface of the coupling rod 351 to provide an elastic force for translational motion of the coupling rod 351.

The coupling rod 351 may include a first coupling rod 352 disposed on one side of left and right surfaces of the water tank 30 and a second coupling rod 353 disposed on the other side. One end of the coupling rod 351 may pass through the left or right surface of the case 31 and then be exposed to the outside. The portion of the coupling rod 351, which is exposed to the outside, may be accommodated into the coupling groove 91 when the water tank 30 is mounted on the water tank chamber 90. A through hole, through which the coupling rod 351 passes, may be defined in each of both side surfaces of the case 31 and the cover 32.

A support for supporting the elastic body 354 may be further disposed on the coupling rod 351. The elastic body 354 may be supported by the support to generate an elastic force.

The support may be disposed on the module seat part 331. The support may not be limited to its position if the support supports the elastic body 354 to allow the elastic body 354 to provide an elastic force to the coupling rod 351.

An end of the coupling rod 351, which is exposed to the outside of the case 31, may be smoothly rounded. Thus, when the water tank 30 is coupled to or separated from the main body 20, damage of the end of the coupling rod 351 or a portion of the coupling groove 91 may be prevented.

An operation of the water tank 30 according to an embodiment may be described.

Figure 15:
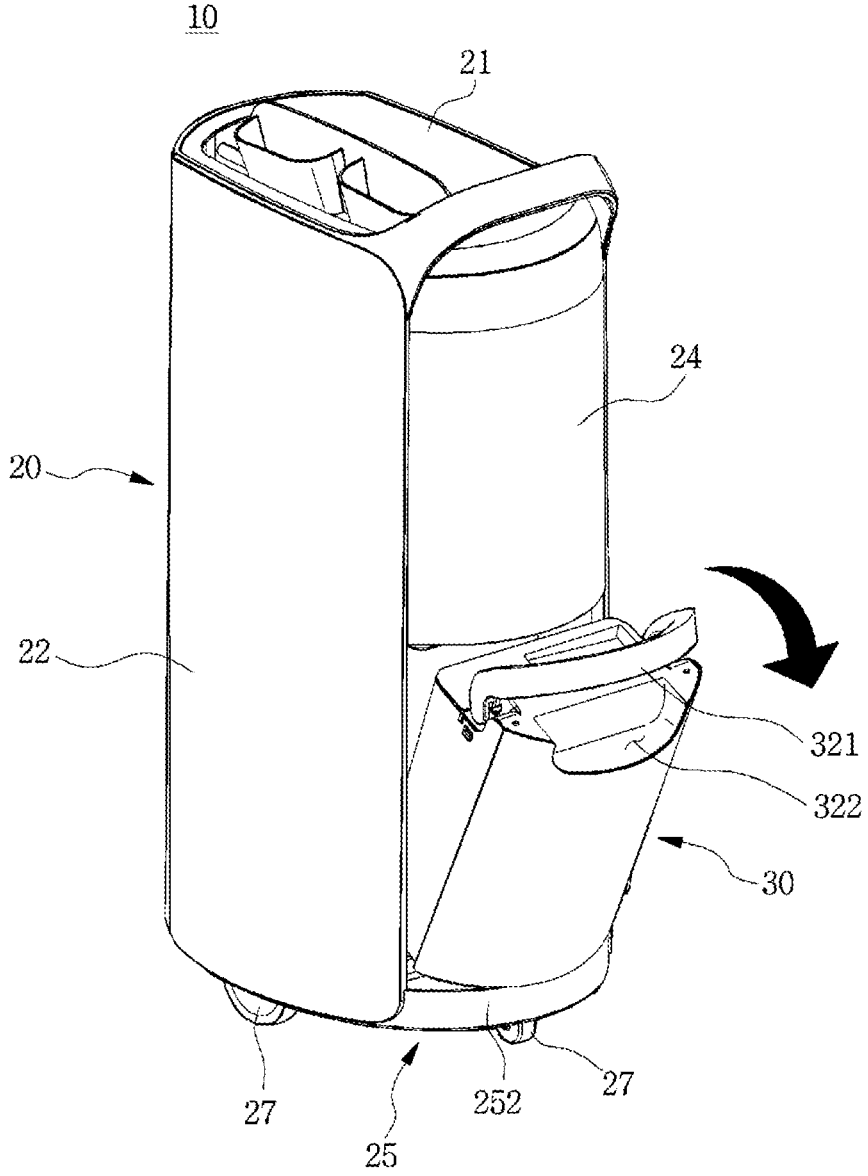
FIG. 15 is a front perspective view illustrating the state in which the water tank of the dehumidifier is separated according to an embodiment.
Figure 16:
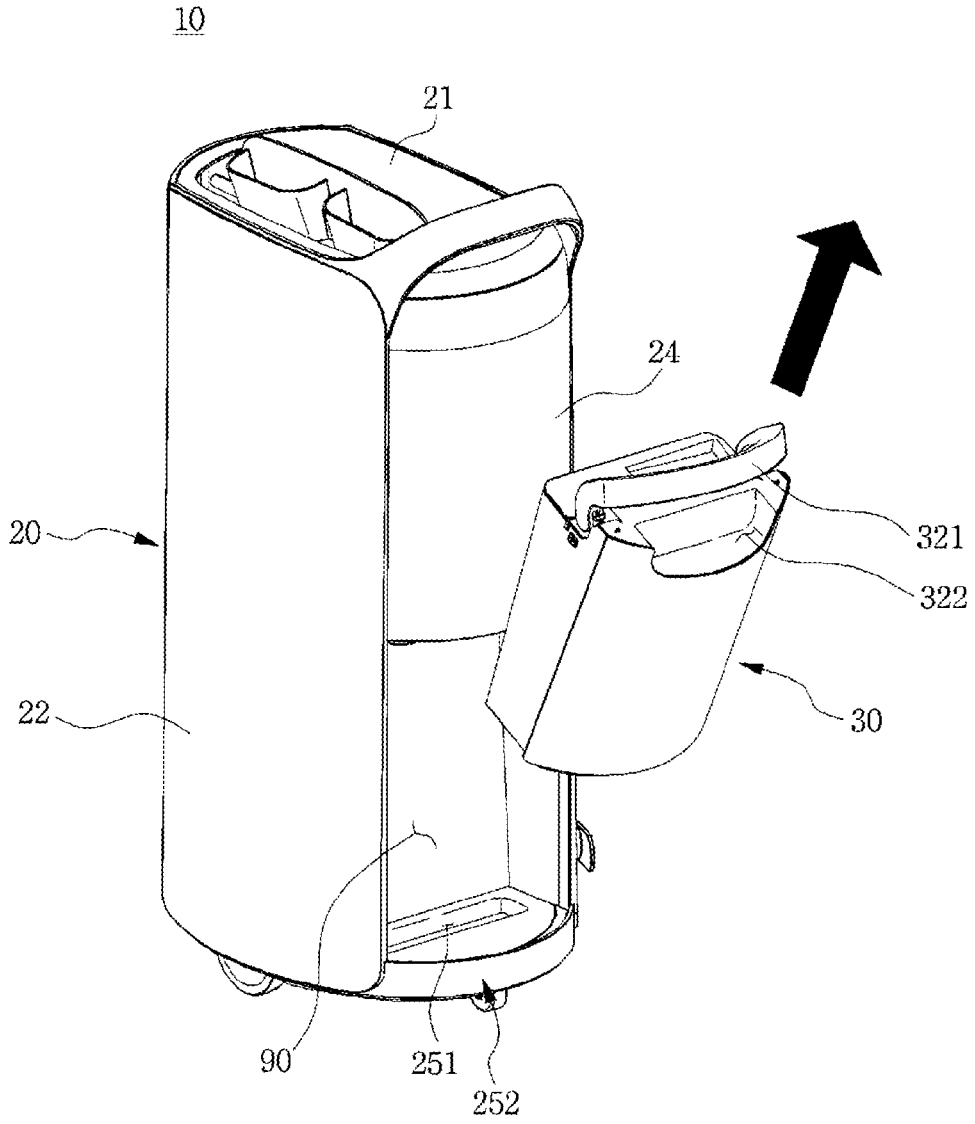
FIG. 16 is a rear perspective view illustrating the state in which the water tank of the dehumidifier is separated according to an embodiment.
Figure 17:
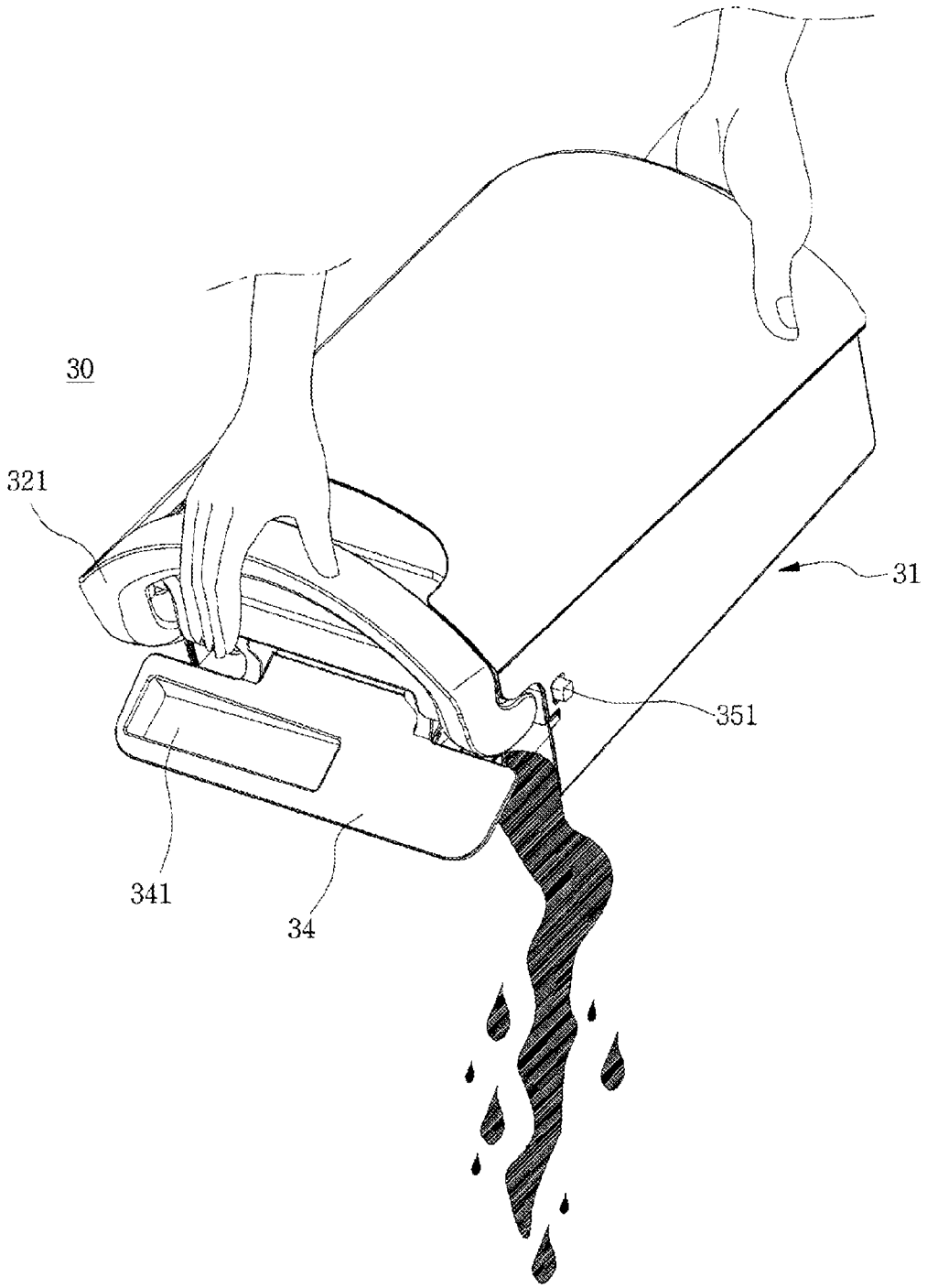
FIG. 17 is a perspective view illustrating an operation for discarding condensed water received in the water tank of the dehumidifier according to an embodiment.

FIG. 15 is a front perspective view illustrating the state in which the water tank of the dehumidifier is separated according to an embodiment. FIG. 16 is a rear perspective view illustrating the state in which the water tank of the dehumidifier is separated according to an embodiment. FIG. 17 is a perspective view illustrating an operation for discarding condensed water received in the water tank of the dehumidifier according to an embodiment.

Referring to FIGS. 15 to 17, the user may have to separate the water tank 30 from the main body 20 so as to discard the condensed water filled in the water tank 30. For this, the user may grasp the tank handle 321 to pull the tank handle 321 in a right direction of the main body 20. When the user pulls the tank handle 321, the upper end of the water tank 30 may rotate in the state where movement of the lower end of the water tank 30 is restricted by interference between the restriction rib 253 and the stepped portion 314 formed on the lower end of the case 31.

The coupling rod 351, inserted into the coupling groove 91 by passing through both side surfaces of the water tank 30, may be separated from the coupling groove 91 due to contraction of the elastic body 354 and thus be inserted into the water tank 30. When the end of the coupling rod 351 completely gets out of the guide part 95 while moving along the guide part 95, the end of the coupling rod 351 may protrude from the side surface of the water tank 30 by a restoring force of the elastic body 354.

That is, the upper end of the water tank 30 may be laterally tilted at a predetermined angle with respect to the main body 20. The user may then lift the water tank 30 upward in the state where the water tank 30 is tilted with respect to the main body 20 to separate the water tank 30 from the main body 20. The lifting direction of the water tank may be equal to the tilted direction of the water tank 30.

The user may further horizontally pull the tank handle 321 in the state where the user grasps the tank handle 321 to separate the water tank 30. However, in this example, the condensed water received in the inner space of the water tank 30 may leak to outside of the water tank 30. Thus, it is preferably that the water tank 30 is separated from the main body 20 while moving upward in the state where the water tank 30 is tilted at a predetermined angle.

When the water tank 30 is separated from the main body 30, the user may lift the lower end of the water tank 30 by using the other hand of the user in the state where the user grasps the tank handle 321. Thus, the stored water may be concentrated toward the drain cover 34, and the drain cover 34 may be opened by a flow pressure of the condensed water. As a result, the drain cover 34 may rotate by using the coupled portion of the coupling cover 33 as a rotation center to open a portion of the top surface of the water tank 30. As a result, the opening closed by the drain cover 34 may be opened to drain the condensed water to the outside.

When the water filled in the case 31 is completely discharged, the user locates the lower end of the water tank 30 on the bottom of the installation surface. As a result, the drain cover 34 may freely rotate by a self-weight thereof to cover a portion of the opened top surface of the case 31 again.

In the state where the drain cover 34 covers a portion of the opened top surface of the case 31, the user may mount the water tank 30 on the main body 20 by reversely performing the process of separating the water tank 30 from the main body 20.

The dehumidifier including the above-described constitutions according to example embodiments may have following effects.

First, since the water tank is detachable in a lateral direction of the rear case having the inflow hole through which air is introduced, the water tank may be easily detachable, and use convenience may be improved.

Second, since the water tank is laterally detached, the outer appearance of the front surface of the dehumidifier may be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier comprising:

a main body defining an outer appearance thereof and having:

a bottom surface;

a front surface;

a rear surface that is opposite of the front surface;

a top surface;

a first side surface;

a second side surface that is opposite of the first side surface;

a handle formed at the top surface;

a water tank chamber formed in the first side surface; and a restriction rib extending upward from a lower end of the water tank chamber;

a heat exchange unit installed inside the main body; and a water tank detachably mounted in the main body to be separated or mounted through a side surface of the main body, the water tank configured to store condensed water formed on the heat exchange unit, wherein the water tank includes:

a case having a front surface forming a portion of the first side surface of the main body, and a space for storing the condensed water;

a cover to selectively open or close a surface of the case;

a coupling module provided at each side portion of the water tank, the coupling module configured to pass through a side surface of the cover and a side surface of the case, to be coupled to the main body; and a tank handle coupled to the cover, wherein, when the water tank is separated from the water tank chamber, the lower end of the front surface of the water tank is restricted by the restriction rib, an upper end of the water tank is tilted or rotated in a first direction, and the tank handle is configured to rotate in a second direction that is opposite of the first direction.

2. The dehumidifier according to claim 1, further comprising:

a coupling groove provided at each inner side surface of the water tank chamber; and a guide part recessed in each inner side surface of the water tank chamber and extending from the coupling groove towards an outside of the water tank chamber.

3. The dehumidifier according to claim 2, wherein the coupling module includes:

a coupling rod horizontally disposed on a side portion of an inside of the water tank; and an elastic member at an outer surface of the coupling rod, wherein an end of the coupling rod protrudes by passing through a side surface of the cover and a side surface of the case, wherein, when the water tank is completely received in the water tank chamber, the end of the coupling rod is disposed in the coupling groove.

4. The dehumidifier according to claim 3, wherein the cover includes a coupling module seat part that is recessed to provide a space for receiving the coupling module.

5. The dehumidifier according to claim 1, wherein the cover includes:

a coupling cover detachably coupled to an opened top surface of the case, to cover at least a portion of the opened top surface of the case, the coupling cover having a grasping groove that is recessed from a portion where is corresponding to a lower side of the tank handle; and a drain cover rotatably coupled to the coupling cover, to cover a remaining portion of the opened surface of the case.

6. The dehumidifier according to claim 5, wherein the drain cover includes a condensed water guide part to guide the condensed water from the heat exchange unit and into the case.

7. The dehumidifier according to claim 1, further comprising:

a movable member configured to be movable based on a water level of the condensed water;

a sensor room at an inner sidewall of the case to accommodate the movable member; and a room cover to cover a surface of the sensor room.

8. The dehumidifier according to claim 1, wherein the main body further having:

a deco panel at a lower portion of the first side surface thereof, wherein the water tank has a stepped portion on a lower portion thereof, such that the restriction rib contacts the stepped portion to form a smooth surface on outer surfaces of the water tank and the deco panel.

9. The dehumidifier according to claim 3, wherein, when the water tank is tilted or rotated to be separated from the water tank chamber, the end of the coupling rod is separated from the coupling groove and moves along the guide part, after the elastic member is contracted, and wherein, when the water tank is further tilted or rotated until the end of the coupling rod is separated from the guide part, the end of the coupling rod protrudes from the side surface of the water tank by a restoring force of the elastic member.

* * * * *